US005116151A

United States Patent [19]

Lytton et al.

[11] Patent Number: 5,116,151

[45] Date of Patent: May 26, 1992

[54] CEILING FAN CLEANING APPARATUS

[76] Inventors: Linda E. Lytton, P.O. Box 650; Richard D. Perron, P.O. Box 189, both of Homosassa Springs, Fla. 32647

[21] Appl. No.: 729,325

[22] Filed: Jul. 12, 1991

[51] Int. Cl.[5] ..... A47L 25/00; A47L 4/02; A47L 13/17

[52] U.S. Cl. ..... 401/9; 401/10; 401/11; 401/140; 401/179; 401/205; 15/210 R

[58] Field of Search ..... 401/205, 9, 10, 11, 401/179, 140; 15/210 R, 210 A

[56] References Cited

U.S. PATENT DOCUMENTS

| | | | |
|---|---|---|---|
| 1,538,603 | 5/1925 | Taylor et al. | 401/179 |
| 2,438,843 | 3/1948 | Correa | 401/179 X |
| 2,789,307 | 4/1957 | Sussman et al. | 401/10 |
| 3,388,415 | 6/1968 | Warner et al. | 15/210 R |
| 3,811,783 | 5/1974 | Johnson | 401/9 |
| 3,981,595 | 9/1976 | Blake | 401/9 X |
| 3,989,388 | 11/1976 | Sparr, Sr. | 401/11 |
| 4,403,881 | 9/1983 | Keeton | 401/140 X |
| 4,841,592 | 6/1989 | Restivo | 15/210 R |

FOREIGN PATENT DOCUMENTS

| | | | |
|---|---|---|---|
| 1171623 | 10/1958 | France | 15/210 R |
| 933632 | 8/1963 | United Kingdom | 15/210 R |

*Primary Examiner*—Steven A. Bratlie
*Attorney, Agent, or Firm*—Leon Gilden

[57] ABSTRACT

A plate member mounting an "L" shaped flange to a forward terminal end thereof defines a channel for receiving a ceiling fan blade therewithin, wherein the organization includes a handle mounted thereto. A modification of the invention includes a handle extension, wherein the handle includes a reservoir to effect projection of fluid into the plate structure of the apparatus and direct such cleaning fluid into a covering fabric to enhance cleaning of associated fan blade structure.

1 Claim, 4 Drawing Sheets

CEILING FAN CLEANING APPARATUS

BACKGROUND OF THE INVENTION

1. Field of the Invention

The field of invention relates to cleaning apparatus, and more particularly pertains to a new and improved ceiling fan cleaning apparatus wherein the same is arranged to receive a ceiling fan blade and effect cleaning thereof.

2. Description of the Prior Art

Ceiling fans are contemporarily used and typically of difficult and remote access to discourage regular and periodic cleaning of such fan structure. Typically, dust and the like is accumulated about a ceiling fan blade, wherein the cleaning blades, due to their typical height above a floor surface, are somewhat difficult to obtain access thereto. Prior art cleaning structure is typified in U.S. Pat. No. 2,723,412 to Harris wherein opposed sponge-like surfaces are arranged to receive a fan blade therebetween.

U.S. Pat. No. 2,819,484 to Fouse sets forth a cleaning tool utilizing spaced sponge-like members to receive the blade structure of a fan between the sponge members.

U.S. Pat. No. 4,841,592 to Restivo sets forth a fan blade cleaning tool wherein a tool includes a housing to receive a fan blade therethrough.

U.S. Pat. No. 4,827,556 to Corsetti sets forth a ceiling fan blade apparatus wherein an elongate tubular handle includes a "Y" shaped fork member at a forward terminal end thereof to mount a cleaning garment thereon.

U.S. Pat. No. 4,823,431 to Carpenter sets forth a fan blade cleaning device wherein an encircling housing includes brush structure and the like mounted therewithin to receive the fan and clean the same directed therethrough.

As such, it may be appreciated that there continues to be a need for a new and improved ceiling fan cleaning apparatus as set forth by the instant invention which addresses both the problems of ease of use as well as effectiveness in contruction and in this respect, the present invention substantially fulfills this need.

SUMMARY OF THE INVENTION

In view of the foregoing disadvantages inherent in the known types of ceiling fan cleaning apparatus now present in the prior art, the present invention provides a ceiling fan cleaning apparatus wherein the same is arranged to permit individuals remotely positioned relative to a ceiling fan access thereto for cleaning thereof. As such, the general purpose of the present invention, which will be described subsequently in greater detail, is to provide a new and improved ceiling fan cleaning apparatus which has all the advantages of the prior art ceiling fan cleaning apparatus and none of the disadvantages.

To attain this, the present invention provides a plate member mounting an "L"shaped flange to a forward terminal end thereof defining a channel for receiving a ceiling fan blade therewithin, wherein the organization includes a handle mounted thereto. A modification of the invention includes a handle extension, wherein the handle includes a reservoir to effect projection of fluid into the plate structure of the apparatus and direct such cleaning fluid into a covering fabric to enhance cleaning of associated fan blade structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ceiling fan cleaning apparatus which has all the advantages of the prior art ceiling fan cleaning apparatus and none of the disadvantages. It is another object of the present invention to provide a new and improved ceiling fan cleaning apparatus which may be easily and efficiently manufactured and marketed.

It is a further object of the present invention to provide a new and improved ceiling fan cleaning apparatus which is of a durable and reliable construction.

An even further object of the present invention is to provide a new and improved ceiling fan cleaning apparatus which is susceptible of a low cost of manufacture with regard to both materials and labor, and which accordingly is then suceptible of low prices of sale to the consuming public, thereby making such ceiling for cleaning apparatus economically available to the buying public.

Still yet another object of the present invention is to provide a new and inproved ceiling fan apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
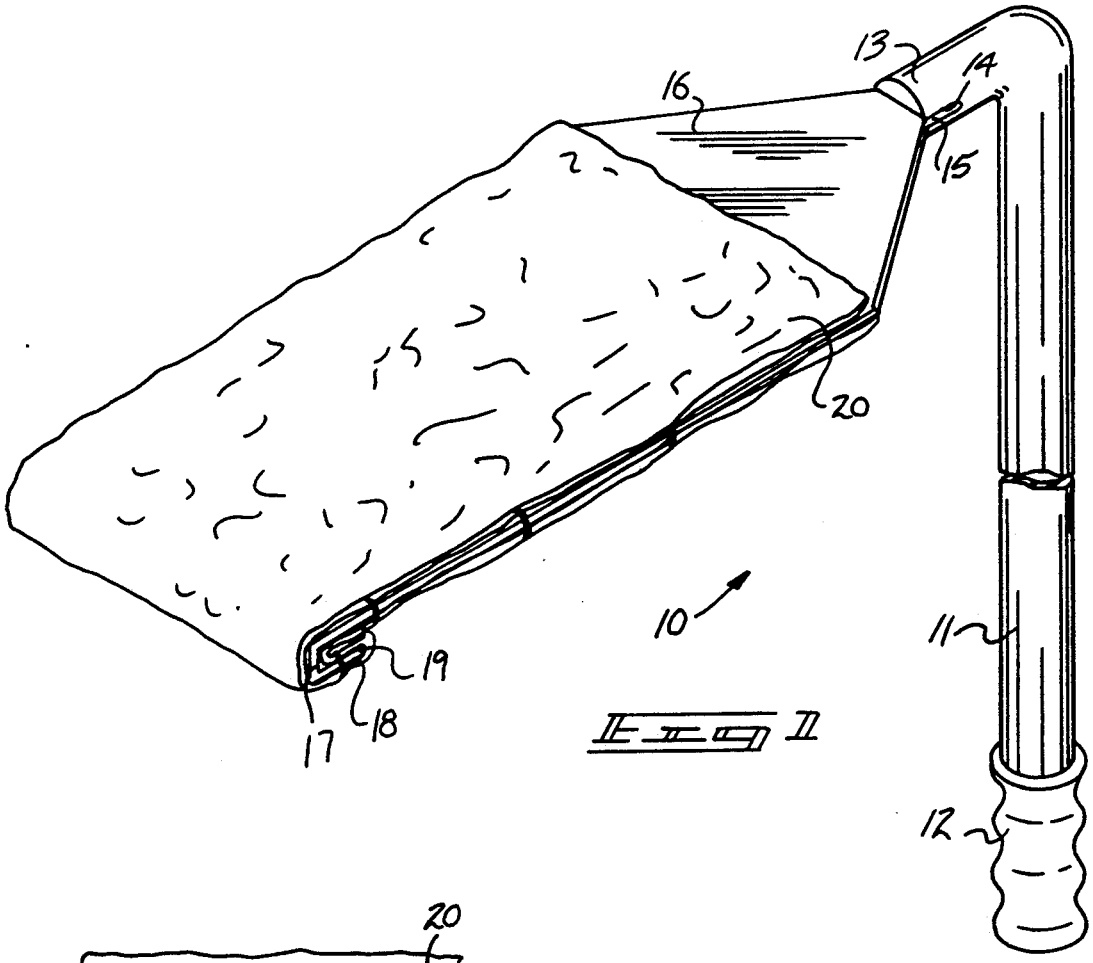
FIG. 1 is an isometric illustration of the instant invention.
Figure 2:
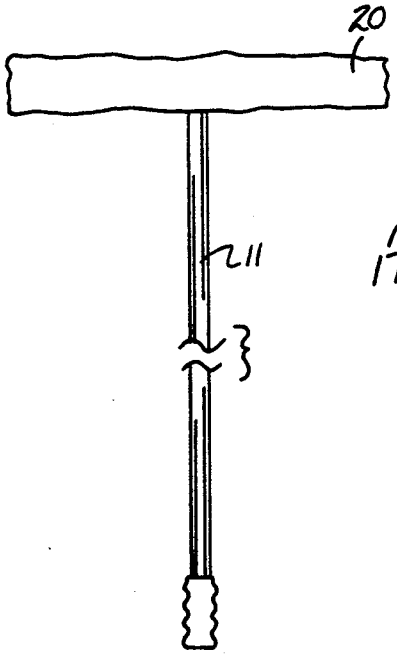
FIG. 2 is an orthographic frontal view, taken in elevation, of the instant invention.
Figure 3:
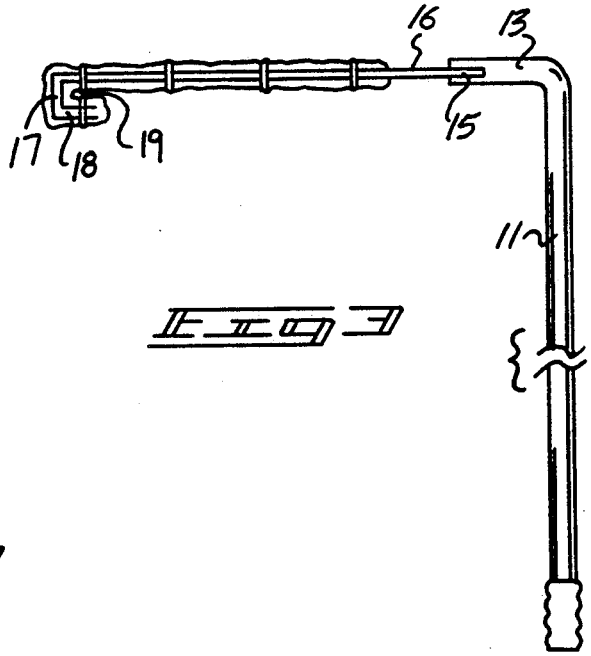
FIG. 3 is an orthographic side view of the invention, taken in elevation.
Figures 4, 5:
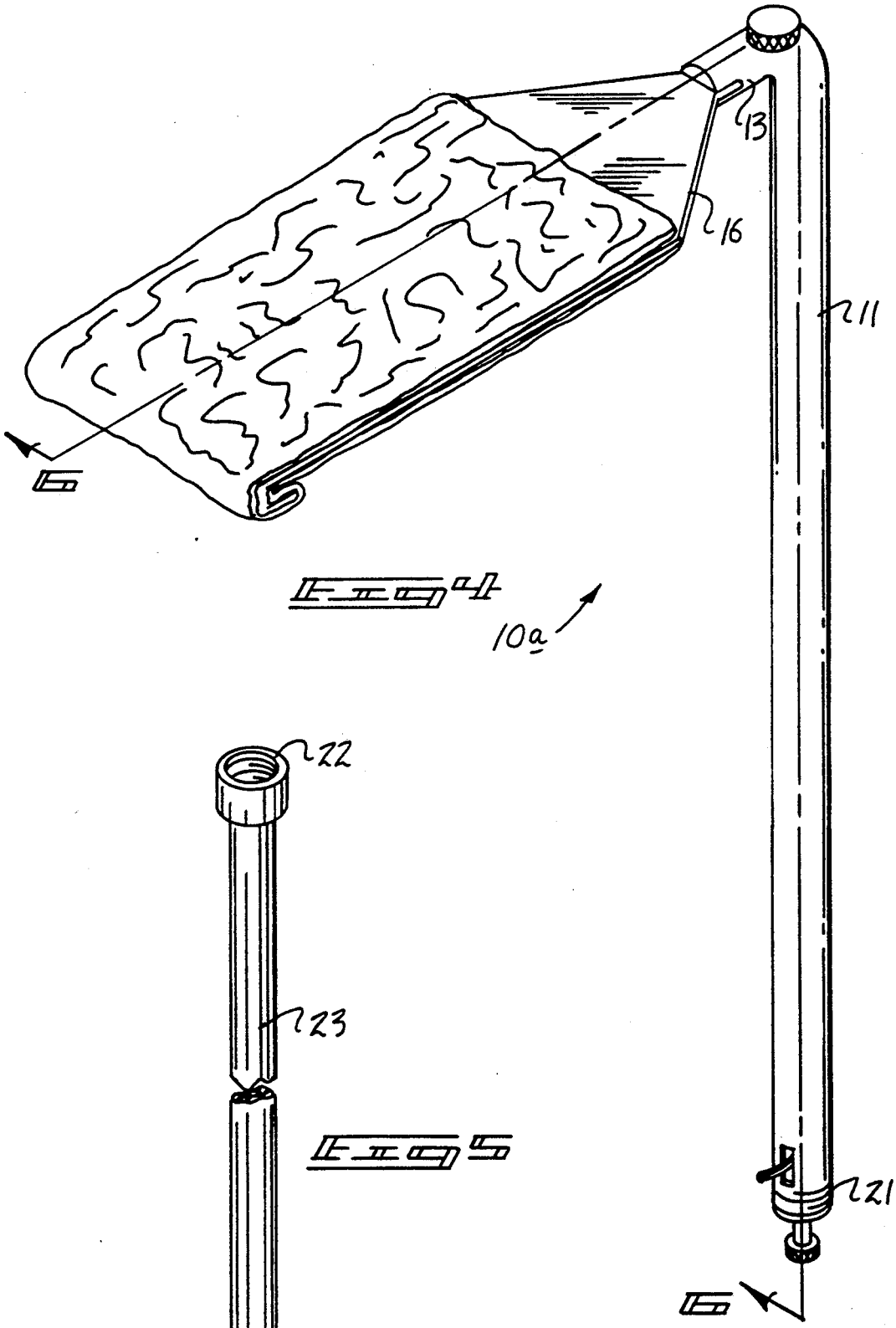
FIG. 4 is an isometric illustration of a modification of the instant invention.
FIG. 5 is an isometric illustration of an extension handle structure utilized by the instant invention.
Figure 6:
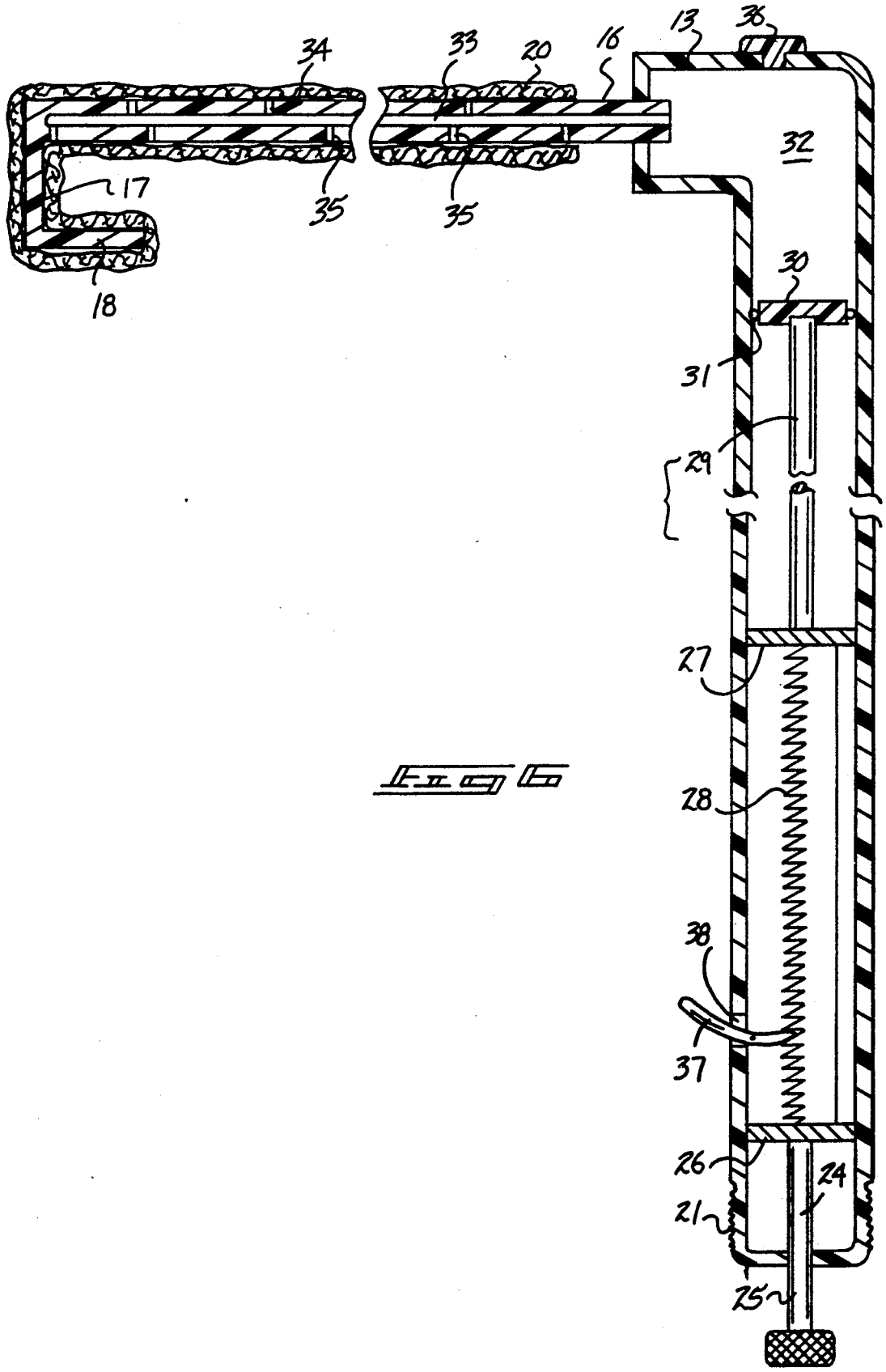
FIG. 6 is an orthographic view, taken along the lines 6—6 of FIG. 4 in the direction indicated by the arrows.
Figure 7:
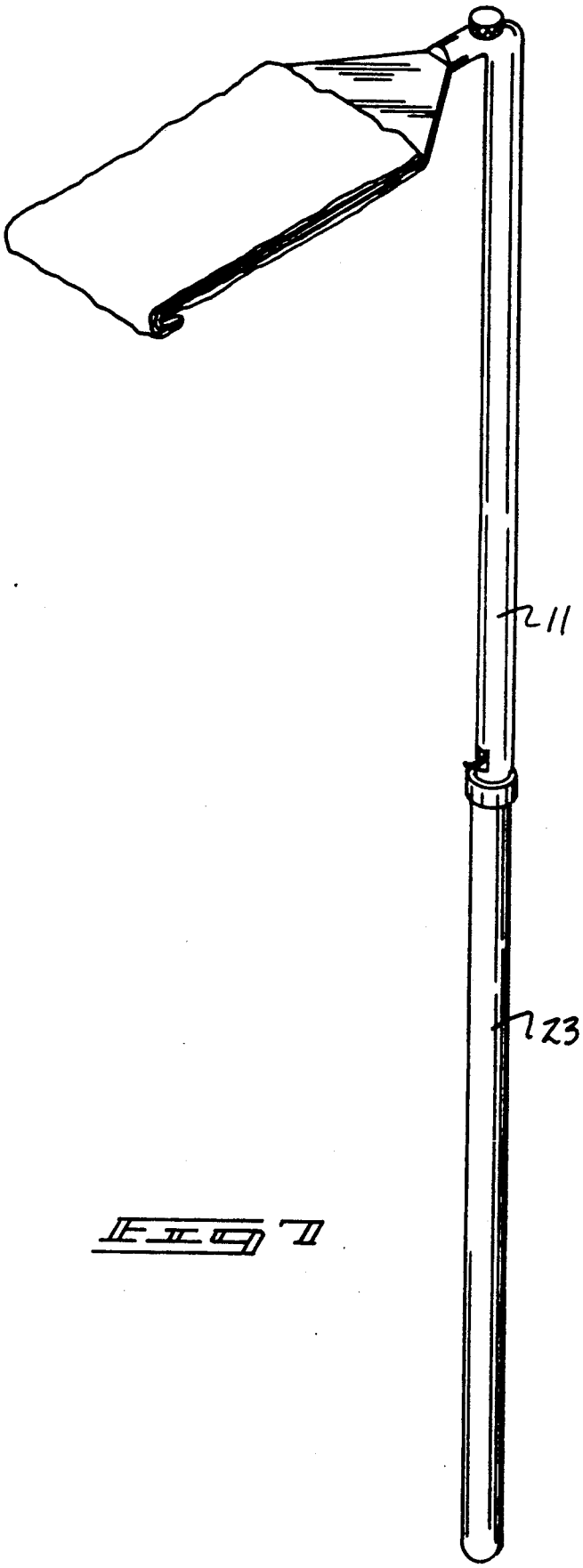
FIG. 7 is an isometric illustration of the modified cleaning apparatus in an assembled configuration.

With reference now to the drawings, and in particular to FIGS. 1 to 7 thereof, a new and improved ceiling fan cleaning apparatus embodying the principles and concepts of the present invention and generally designated by the reference numerals 10 and 10*a* will be described.

More specifically, the ceiling fan cleaning apparatus 10 of the instant invention essentially comprises an elongate handle first leg 11 orthogonally mounting a handle second leg orthogonally thereto at an upper terminal end thereof. A handle sleeve 12 is mounted to a lower terminal end of the first leg 11 to enhance grasping of the first leg 11. The second leg 13 includes a second leg slot 14 diametrically directed through a forward end of the second leg 13 and oriented orthogonally relative to axis of the first leg 11. A mounting flange 15 of a planar upper plate 16 is received fixedly within the second leg slot 14 of a first length. A connecting web 17 projects downwardly and orthogonally relative to a forward terminal end of the upper plate 16, with a planar lower plate 18 orthogonally mounted to the connecting webs 17 arranged below and parallel the upper plate 16. The lower plate 18 is of a second length substantially less than the first length to define a cleaning channel 19 to receive an edge portion of a fan blade therewithin, wherein a fibrous fluid absorbent covering 20 is mounted coextensively of the upper plate 16, connecting web 17, and the lower plate 18, wherein cleaning is effected by the cleaning channel 19 in a bottom surface of the upper plate 16 and the associated covering 20. A top surface of the upper plate 16 and the associated covering 20 permits cleaning of a lower surface of the fan blade of conventional construction.

FIGS. 4–7 illustrate the use of a modified apparatus 10*a*, wherein the first leg 11 includes an externally threaded lower end portion 21, wherein an internally threaded socket 22 mounted at an upper terminal end of extension handle 23 and coaxially aligned therewith threadedly receives the lower end portion 21 therewithin to provide an extension handle as required for access to remotely positioned fan blades. A plunger shaft 24 is coaxially directed through a lower end of the handle 11 defining an extension shaft 25. A lower ratchet plate 26 is orthogonally mounted to an upper terminal end of the plunger shaft 24 within the handle first leg 11, with an upper ratchet plate 27 spaced from the lower ratchet plate 26 to mount a ratchet member 28 therebetween. Ratchet brake lever 37 is pivotally mounted within a first handle apertures 38 directed through a side wall of the first handle 11 for engagement with the ratchet member 28. In this manner, pivotment of the lever 37 or projection of the plunger shaft 24 and extension 25 into the handle 11 effects compression of an associated reservoir chamber 32 and associated cleaning fluid therewithin. The upper ratchet plate 27 mounts a piston rod 29 medially and orthogonally thereof, with a piston 30 mounted to an upper terminal end of the piston rod 29, including an annular seal 31 in surrounding relationship relative to the piston rod and interior wall of the handle 11. A fluid conduit 33 is directed through the upper plate 16 and includes upper and lower feed conduits 34 and 35 orthogonally directed through the upper plate 16 into communication with an upper and lower surface of the associated upper plate 16 to effect directing of cleaning fluid into the fibrous covering 20 overlying the upper and lower surfaces of the upper plate 16. A fill plug 36 removably mounted relative to the second leg 13 permits selective filling of the reservoir 32 as required. In this manner, the covering 20 may be periodically replenished with cleaning fluid to effect cleaning of an associated fan blade member engaged by the covering 20.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operattion shown and described, and accordingly, all suitable modifications and equivalents may be resorted to, falling within the scope of the invention.

What is claimed as being new and desired to be protected by Letters Patent of the United States is as follows:

1. A ceiling fan cleaning apparatus, comprising, an elongate handle first leg, the elongate handle first leg including a first leg upper terminal end, and defined along a central axis, and a handle second leg orthogonally mounted to an upper terminal end of the first leg orthogonally oriented relative to the central axis, and a second leg slot diametrically directed through a forward end of the second leg orthogonally oriented relative to the central axis, and a planar upper plate mounted fixedly within the second leg slot, and the upper plate includes an upper plate forward edge, and connecting web orthogonally mounted to the upper plate at the forward edge, and the connecting web including a lower edge, and a planar lower plate orthogonally mounted to the connecting web lower edge arranged parallel to and below the planar upper plate to define a cleaning channel between the upper plate, lower plate, and connecting web, and a fibrous fluid absorbent covering mounted substantially coextensively about the upper plate, lower plate, and connecting web, and wherein the upper plate is defined by a first length, and the lower plate is defined by a second length, and the second length is substantially less than the first length to permit ease of mounting of the lower plate about a fan blade for effective cleaning of an edge portion of the fan blade, and wherein the first leg includes an externally threaded lower end portion, and including an extension handle, the extension handle including an internally threaded socket fixedly and coaxially mounted to an upper terminal end of the extension handle, and the internally threaded socket is arranged for threadedly receiving the externally threaded end portion of the first leg, and including a plunger shaft reciprocatably mounted through a lower end portion of the first leg, and the plunger shaft extending into the first leg orthogonally mounting a lower ratchet plate fixedly thereon, an upper ratchet plate spaced from the lower ratchet plate within the first leg, and a ratchet member fixedly mounted orthogonally between the lower ratchet plate and the upper ratchet plate, and a first handle aperture directed through the first leg, and a ratchet brake lever pivotally mounted within the first leg in communication with the ratchet member and the ratchet brake lever extending exteriorly of the first leg permitting pivotment of the ratchet member to effect selective reciprocation of the ratchet member, and a piston member mounted fixedly and in a spaced relationship relative to the upper ratchet plate, and the piston member including an annular seal mounted thereabout to effect a sealing relationship between the piston member and an interior surface of the first leg, and a reservoir chamber defined between the piston member and the second leg slot, whereupon projection of the piston member within the reservoir effects pressurizing of the reservoir, and wherein the upper plate includes a fluid conduit directted substantially coextensively and longitudinally thereof, with the fluid conduit including a plurality of upper feed conduits directing fluid from the fluid conduit to an upper surface of the upper plate, and a plurality of lower feed conduits in communication with the fluid conduit directing fluid from the fluid conduit and reservoir chamber to a lower surface of the upper plate, wherein the upper and lower feed conduits permit directing of cleaning fluid contained within the reservoir chamber into the covering contained about the upper plate.

* * * * *